US005803592A

United States Patent [19]

Lawson

[11] Patent Number: 5,803,592

[45] Date of Patent: Sep. 8, 1998

[54] LIGHT SOURCE

[75] Inventor: Lawrence Richard Lawson, Bradford, Pa.

[73] Assignee: Austin Air Systems Limited, Buffalo, N.Y.

[21] Appl. No.: 755,011

[22] Filed: Nov. 22, 1996

[51] Int. Cl.[6] ..... F21V 13/10

[52] U.S. Cl. ..... 362/300; 362/84; 362/303; 362/307; 362/350

[58] Field of Search ..... 362/297, 298, 362/300–303, 341, 343, 347, 350, 307, 84

[56] References Cited

U.S. PATENT DOCUMENTS

| | | | |
|---|---|---|---|
| 1,219,583 | 3/1917 | Perry | 362/300 |
| 1,249,133 | 12/1917 | Lebby | 362/303 |
| 1,279,096 | 9/1918 | Fitz Gerald | 362/298 |
| 1,302,492 | 5/1919 | Arenberg | 362/300 |
| 1,515,221 | 11/1924 | Roberts et al. | 362/303 |
| 1,811,782 | 6/1931 | Duncan, Jr. | 313/113 |
| 4,288,844 | 9/1981 | Fisher et al. | 362/33 |
| 4,463,410 | 7/1984 | Mori | 362/20 |
| 4,584,631 | 4/1986 | Cody et al. | 362/61 |
| 4,706,173 | 11/1987 | Hamada et al. | 362/341 |
| 4,731,713 | 3/1988 | Perthus | 362/302 |
| 5,128,848 | 7/1992 | Enders et al. | 362/268 |
| 5,479,328 | 12/1995 | Lee et al. | 362/216 |
| 5,515,255 | 5/1996 | Nielson et al. | 362/297 |
| 5,523,930 | 6/1996 | Fritts | 362/223 |

*Primary Examiner*—Alan Cariaso
*Attorney, Agent, or Firm*—Nixon & Vanderhye P.C.

[57] ABSTRACT

A Lambertian light source assembly has high uniformity, large size, and high brightness, typically having a non-uniformity about 10% or less (e.g. about 5%), and a surface brightness of at least about 2000 footlamberts. The assembly includes a light emitting element (such as a single arc lamp, e.g. a metal halide lamp), a first reflector having an interior diffuse reflective surface comprising a portion of a surface of revolution and a center axis, a second reflector, and a diffuser. The diffuser is connected to the first reflector. The light emitting element is substantially centrally located on the center axis, and the second reflector is located between the diffuser and the light emitting element and reduces the apparent surface brightness at the center of the first reflector and blocks the majority (e.g. all, or almost all except adjacent the first reflector) of direct illumination of the diffuser by the light emitting element. The surface of revolution has a radius R and the light emitting element is positioned on the center axis approximately 0.1 R from the first reflector interior surface, the second reflector is positioned approximately 0.2 R from the first reflector interior surface along the center axis, and the second reflector has a diameter, substantially perpendicular to the center axis, of approximately 0.3 R–0.4 R (e.g. 0.35 R). The first reflector interior surface may comprise integrating sphere paint, which may have pigments or phosphors for color correction.

20 Claims, 4 Drawing Sheets

LIGHT SOURCE

BACKGROUND AND SUMMARY OF THE INVENTION

There are many applications, such as the transillumination of dense x-ray films, the photo-reduction of transparencies, the shadlowless illumination of objects including the human face and for certain types of medical treatment lamps which must be viewed directly by the patient, where a Lambertian light source having high brightness and often large size is desirable. While diffuse reflection is commonly used in light fixtures, it is treated in design either haphazardly or aesthetically, due to its intrinsically forgiving nature with respect to angles and placements. Detailed ray tracing is seldom applied to the design of such fixtures. Light source designs based on ray tracing usually utilize specular reflection, such as shown in U.S. Pat. Nos. 1,515,221, 1,811,782, and 1,279,096 as well as high uniformity. Diffuse reflection has also been employed from time to time in the construction of laboratory surface brightness standards. These standards have often utilized integrating spheres or partial integrating spheres, to achieve extremely high uniformity. But, these designs, requiring multiple reflections off a diffuse reflective surface, have been costly and inefficient. Consequently, they have not found applications in general lighting. The light source assembly according to the invention preferably takes advantage of diffuse reflection rather than specular reflection to achieve these goals, and typically provides a unique geometric arrangement between component parts which help achieve its advantageous results.

"Uniformity" is typically measured by percentage of non-uniformity, high uniformity being a low percentage of non-uniformity. Non-uniformity is the ratio of the difference of the brightest and dimmest surface brightness areas (of the surface) divided by the average surface brightness. High uniformity is achieved when non-uniformity is about 10% or less, and non-uniformity in the 5–10% range is considered highly desirable and may be readily obtained according to the present invention. "Brightness" relates to the surface brightness (brightness of a surface) and is typically measured in footlamberts. While what "high brightness" is depends upon the particular application, a surface brightness of about 2000 footlamberts or more is considered "high brightness" for many applications, and can also readily be obtained according to the present invention.

According to one aspect of the present a light source assembly is provided comprising the following: A light emitting element. A first reflector having an interior diffuse reflective surface comprising a portion of a surface of revolution, having a center axis. A second reflector. And, a diffuser. The diffuser is connected to the first reflector, the light emitting element is substantially centrally located on the center axis, and the second reflector is located between the diffuser and the light emitting element.

The particular geometric relationship between the elements set forth above that is desirable according to the present invention is determined with respect to the radius, R, of the surface of revolution. The center of the generally rod-like light emitting element is positioned on the central axis approximately 0.1 R from the intersection of that axis with the interior surface of the first reflector. The center of second reflector is positioned on that same axis approximately 0.2 R from its intersection with the first reflector. It has a diameter approximately 0.3-R–0.4 R (e.g. about 0.35 R). Preferably, the center of the diffuser is located on the central axis within a range of ±0.3 R from the origin. With regard to the shape of the first reflector, it should be understood that its shape need not be exactly spherical, but may be ovoid or parabolic etc. to some degree without a material alteration in performance. The exact shape of the second reflector as well as its reflectance are still less consequential. For instance, were the reflectance of the second reflector made equal to zero, good uniformity could still be obtained, but efficiency would be diminished. Hence while the terms "radius" and "diameter" are used in the specification and claims, these are to be understood as being "effective radius" or "effective diameter".

In practice the first reflector preferably is a partial sphere, such as a hemisphere, or a partial ovoid, such as a hemi-ovoid. Alternatively it may be ellipsoidal or parabolic. For example, a paraboloid obtained from a 3-point parabolic fit to the central axis intersection and two opposite points on the edge of a hemispherical primary reflector could be used effectively as a primary reflector producing almost as good a result as the hemispherical reflector itself. In certain instances an ellipsoidal shape, although more difficult to manufacture, might slightly enhance performance.

The light emitting element preferably comprises an arc lamp, such as a metal halide lamp, and only a single lamp is typically necessary, although more than one lamp may be provided where desired. Alternatively a filament lamp may be used instead of an arc. But, for best results, an extended light emitting element should have a cylindrical shape.

The reflecting surface of the first reflector should provide non-directional, diffuse scattering as reflection. The first reflector interior surface may comprise a finish of the material forming the first reflector so that it is a diffuse reflective surface. For example if the first reflector is made out of metal the surface of the metal may be finished in such a way that the interior thereof provides a diffuse reflective surface. Normally the diffuse reflective surface is most easily obtained by providing a coating of diffuse reflective paint, such as integrating sphere paint. A particularly high quality integrating sphere paint is Kodak barium sulfate paint, but cheaper alternatives may be more cost effective. For example, selected kaolins mixed with modified titanium dioxide have proven effective as pigments. Where a paint is utilized, the paint may have added pigments or phosphors for color modification. Since only the diffusely scattered light exits the lamp, the source itself need not emit visible light when phosphors are used. Narrow band illumination may be obtained in this way.

The second reflector concentrates the light energy along the wall of the first reflector thereby increasing the intensity at the edge of the diffuser. It also serves to limit direct illumination of the diffuser to its outer edge if not eliminating it altogether depending on the length of the cylindrical light emitting element. The combination of these geometric effects serves to balance the center and edge intensities. When the diameter of the light emitting element is narrow and its length is short, ripples may appear in the radial intensity function as defined from the center to edge of the diffuser. These may be reduced or eliminated by feathering the edges of the second reflector. The nature of the reflectance of the second reflector is of minor importance in determining intensity distribution. The rear surface should have the highest reflectance possible in order to maximize efficiency. It may be polished although diffuse reflection is generally preferred. The reflectance of front surface of the second reflector has a small effect on the central brightness of the diffuser. Adjusting this reflectance may help fine-tune the central portion of the radial light distribution. The second reflector may be mounted directly on the light emitting element or mounted on any accessory support preferably made of fine spring-tensioned wire.

The diffuser may comprise any suitable diffuser, of a transparent or translucent material typically of hard plastic or glass. The diffuser has an interior surface with an outer periphery adjacent the first reflector. To offset the effect of non-unity index of refraction on rays reaching the outer periphery and making an oblique angle with the normal to the diffuser surface, the diffuser may be given an anti-reflection coating or selective roughening on its internal surface. To reduce heat radiation the diffuser may incorporate an infra-red reflective coating such as is used on window glass. The diffuser may be directly connected to the first reflector and supported by it, either mechanically (by interfering surfaces, or with fasteners) attached, or it may be adhesively attached. Alternatively an indirect connection may be provided.

Where the first reflector is substantially hemispherical and the light emitting element is a single metal halide lamp, the lamp and diffuser may have dimensions proportional to about 175 watts for the lamp and 19 inches in diameter for the diffuser for an R=10 inches first reflector. The surface brightness of the assembly at the diffuser may be at least about 2000 footlamberts, e.g. about 2100 footlamberts, and the non-uniformity at the diffuser is 10% or less (e.g. about 5%).

According to another aspect of the present invention a light source assembly is provided comprising the following: A light emitting element. A first reflector having an interior reflective surface comprising a portion of a surface of revolution having a radius R, and having a center axis. The light emitting element positioned on the center axis approximately 0.1 R from the first reflector interior surface. A second reflector positioned approximately 0.2 R from the first reflector interior surface along the center axis; and having a diameter, substantially perpendicular to the center axis, of approximately 0.3 R–0.4 R (e.g. about 0.35 R). And, a diffuser connected to the first reflector, the second reflector located between the diffuser and the light emitting element.

The details of the second reflector, primary reflector, and other components preferably are as described above.

According to yet another aspect of the present invention a light source assembly is provided comprising the following: A single metal halide lamp. A housing containing the lamp and including an interior and an exterior. At least about half of the housing interior having a diffuse reflective surface. A diffuser defining part of the exterior. And, when the lamp is energized the assembly at the diffuser having a surface brightness of at least about 2000 footlamberts and a non uniformity of 10% or less.

It is the primary object of the present invention to provide a Lambertian light source with high uniformity and high brightness, which can be made in a wide variety of sizes, including large sizes (e.g. of about 250 square inches or more). This and other objects of the invention will become clear from an inspection of the detailed description of the invention and from the appended claims.

DETAILED DESCRIPTION OF THE DRAWINGS

Figure 1:
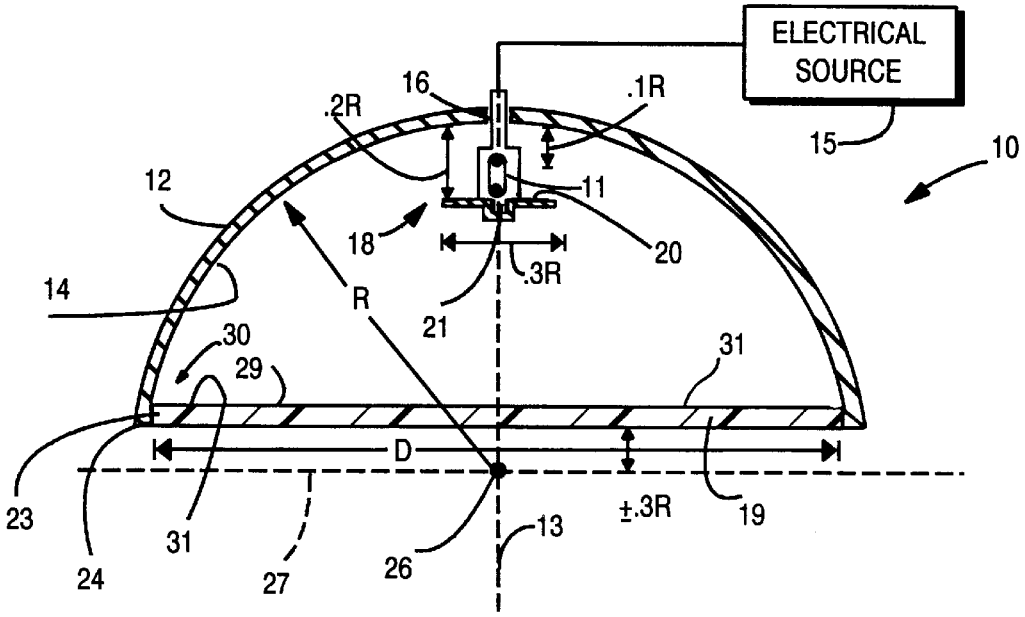
FIG. 1 is a side schematic view, primarily in cross-section but partly in elevation, of an exemplary light source assembly according to the present invention.

An exemplary embodiment of a light source assembly according to the present invention is shown generally by reference numeral 10 in FIG. 1. It comprises a light emitting element 11 which is mounted in a housing, for example the housing defined by a first reflector 12. The first reflector 12 has a center axis 13, and an interior surface 14 comprising a portion of a surface of revolution.

The light emitting element 11 may comprise a wide variety of different elements. For example it may comprise an arc lamp, such as a metal halide lamp, or a filament lamp in which cases the longitudinal axis of the arc or filament is to be coincident with the center axis, 13. A single lamp may be provided in either case and is preferred, although a number of different lamps may be provided if desired. The element 11 is connected up to an electrical source 15 by any conventional means, and the element 11 may be mounted directly to the top 16 (at or adjacent the center axis 13) of the first reflector 12, for example held in place by a collar, bushing, bracket, or the like. Alternatively any other suitable means, such as accessory clamps, brackets, or supports, may be provided for mounting the element 11, as long as it is substantially centrally located on the center axis 13, as illustrated in FIG. 1.

The first reflector 12 may be made of any suitable material having the necessary rigidity and support characteristics, such as a metal, hard plastic, or the like. Regardless of the material of the reflector 12, however, the interior surface 14 is a reflective surface, and desirably a diffuse reflective surface. The diffuse reflective surface may be formed by polishing, finishing, burnishing, or otherwise treating the actual material forming the reflector 12 in some circumstances, or may be formed by providing a coating of material on the reflector 12 to form the reflective surface 14. For example a diffuse reflective paint, such as an integrating sphere paint, may be provided to define the diffuse reflective surface 14. One example of such paint is Kodak barium sulfate paint, but other less expensive alternatives may be more cost effective. Where a paint is utilized, the paint may have conventional pigments or phosphors for color correction.

The first reflector 12 surface of revolution preferably comprises a partial sphere (such as a hemisphere), a partial ovoid (such as a hemi-ovoid), or may be parabolic. As clear from a comparison of FIGS. 1 and 2 (solid line in FIG. 2) a partial sphere, substantially comprising a hemisphere, is illustrated in the drawings. However as shown by dotted line at 12' in FIG. 2 a partial ovoid configuration may alternatively be provided. Alternatively the surface of revolution of the surface 14 may be parabolic; for example a 3 point parabolic fit to the substantially hemispherical surface 14 already illustrated in FIG. 1 would not result in a great degradation in performance. Also instead of the reflector 12' being ovoid as illustrated in FIG. 2, an ovoid insert may instead be provided within the substantially hemispherical reflector 12.

The assembly 10 further comprises a second reflector 18 and a diffuser 19, the second reflector 18 being disposed between the light emitting element 11 and the diffuser 19 along the center axis 13. The second reflector reduces the apparent surface brightness of the center of the first reflector 12, and blocks the majority of direct illumination of the diffuser 19 by the light emitting element 11. In the embodiment illustrated in FIGS. 1 and 2 the second reflector 18 completely blocks direct illumination of the diffuser 19 by the light emitting element 11. The second reflector 18 may be of any suitable material such as metal, the surface facing the light emitting element 20 of which is reflective (e.g. polished, coated, or the like), and the second reflector 18 may be mounted within the assembly 10 by any suitable mechanism. For example as illustrated in FIG. 1 it may be mounted directly on the bottom end 21 of a casing for the light emitting element 11. Alternatively it may be mounted by one or more brackets, clamps, cables, wires, or the like directly to the primary reflector 12 or to some exterior structure.

The diffuser 19 is preferably substantially planar and may comprise any conventional diffuser. Transparent or translucent glass or hard plastic is preferred. The diffuser 19 is connected to the primary reflector 12 either directly or indirectly. For example as illustrated in FIG. 1 the external peripheral lip 23 may actually make surface engagement with the internal periphery of the reflector 12 adjacent the bottom 24 thereof, or it may be held in place by mechanical fasteners such as screws or clamps, or by adhesive. Alternatively the diffuser 19 may be indirectly connected to the reflector 12 by a collar, brackets, or other suitable conventional structures.

Figure 2:
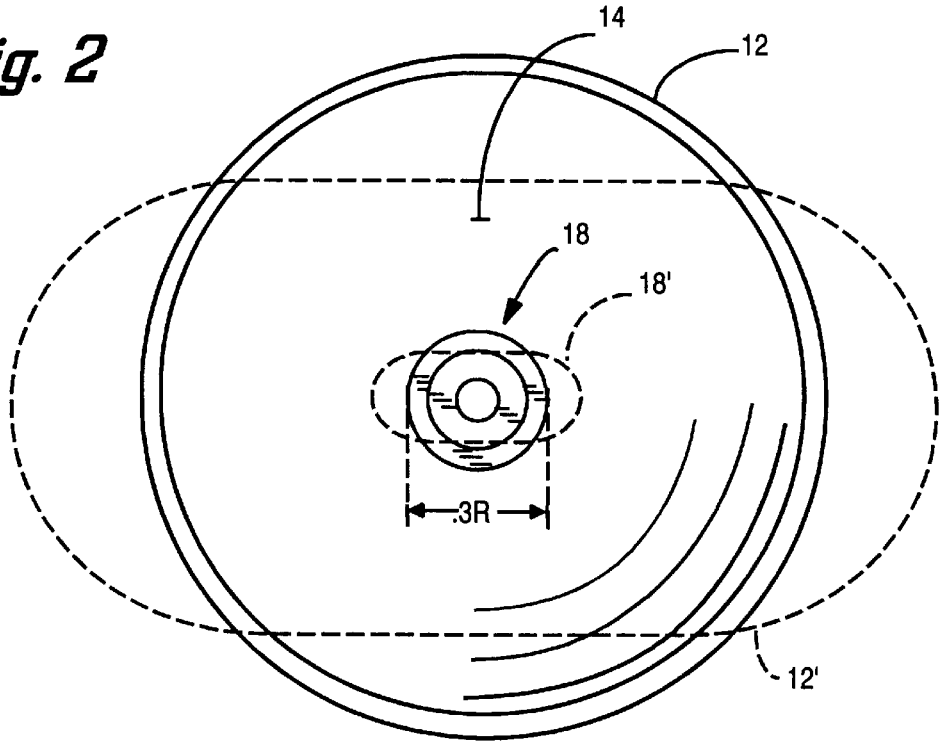
FIG. 2 is a bottom plan view of the assembly of FIG. 1 with the diffuser removed.

In the FIGS. 1 and 2 embodiment the various components are provided with particular geometric relationships. The interior surface 14 surface of revolution has a radius R with the light emitting element 11 positioned on the center axis 13 approximately 0.1 R from the first reflector 12 interior surface 14 at the top 16, and the second reflector 18 surface 20 positioned approximately 0.2 R from the first reflector 12 interior surface 14 along the center axis 13. The second reflector 18 has a diameter, substantially perpendicular to the center axis 13, of approximately 0.3 R–0.4 R (e.g. about 0.35 R) (as seen in both FIGS. 1 and 2). The diffuser 19 is located in a range of ±0.3 R from the intersection 26 of imaginary radii of the first reflector 12 interior surface 14 along the light emitting element (that is the center axis 13) and perpendicular to the light emitting element (shown in dotted in at 27 in FIG. 1). The diffuser 19 typically is circular in plan and has a diameter D, the diameter D equal to 2 R when the surface 14 is an exact hemisphere (that is the diffuser 19 is along the radii 27).

While the values that R and D may take may vary widely, as well as the intensity of the light emitting element 11, for the exemplary structure illustrated in FIGS. 1 and 2 one desirable set of values is for R to equal ten inches, D to equal nineteen inches, element 11 to comprise a single 175 watt metal halide lamp, the surface 14 to be a partial sphere coated with barium sulfate paint, and the second reflector 18 to be circular in plan (as illustrated in solid line in FIG. 2). In such a situation the surface brightness of the diffuser 19 is at least about 2000 footlamberts, typically about 2100 footlamberts, and the assembly 10 has a non-uniformity, at the diffuser 19, of 10% or less (e.g. about 5%). The surface area of diffuser 19 is about 285 square inches.

Where the surface of revolution comprising the surface 14 is a partial ovoid instead of a partial sphere, as shown at 12' in FIG. 2, more than one radius will be provided. In this case the spacings of the element 11 and the second reflector 18 along the center axis 13 will be based upon the minimum radius as the value R while the dimensions of the reflector 18' may vary in proportion to the changing value of R. As illustrated in dotted line at 18' in FIG. 2 the periphery of the second reflector 18' mimics that of the first reflector 12'.

The interior surface 29 of the diffuser 19 has an outer periphery, shown generally at reference numeral 30 in FIG. 1, adjacent the first reflector 12. Sometimes it is desirable to roughen the interior surface 29 as illustrated at 30 to offset the effect of the index of refraction of the diffuser 19 on rays making an oblique angle with a normal to the diffuser interior surface 29.

Figure 3:
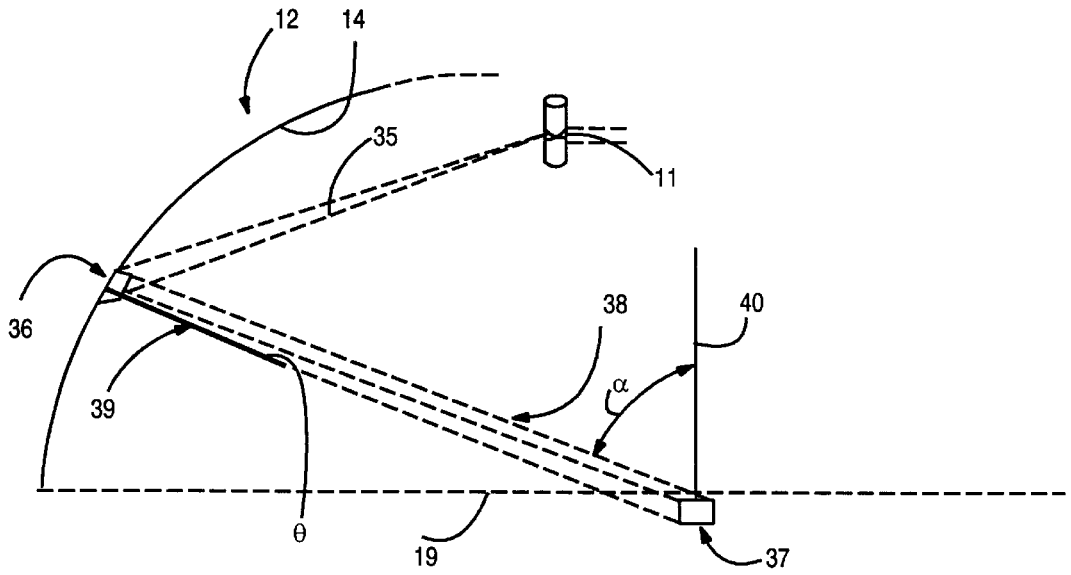
FIG. 3 is a schematic diagram which illustrates diffuse reflection.

FIG. 3 diagrammatically illustrates the diffuse reflection that is provided for the primary reflector 12 surface 14, as opposed to specular reflection. FIG. 3 illustrates an incident ray pencil 35 emanating from the source 11 to a surface element 36 on the surface 14. The reflecting surface element illuminates an element 37 of the diffuser 19 plane, as indicated by the illuminating pencil 38, in an amount which is proportional to (1) the area of the surface element 36, (2) the cosine of the angle $\theta$ between the surface normal 39 and the illuminating pencil 38, (3) the inverse square of the distance between the elements 36, 37, and (4) the cosine of the angle $\alpha$ between the illuminating pencil 38 and the normal 40 to the diffuser 19 plane. In specular reflection the cosine relationship (2) above is replaced by one which allows reflection at one angle only. The illuminance at the diffuser 19 is the sum of all the rays 38 from the surface elements 36.

Figure 4:
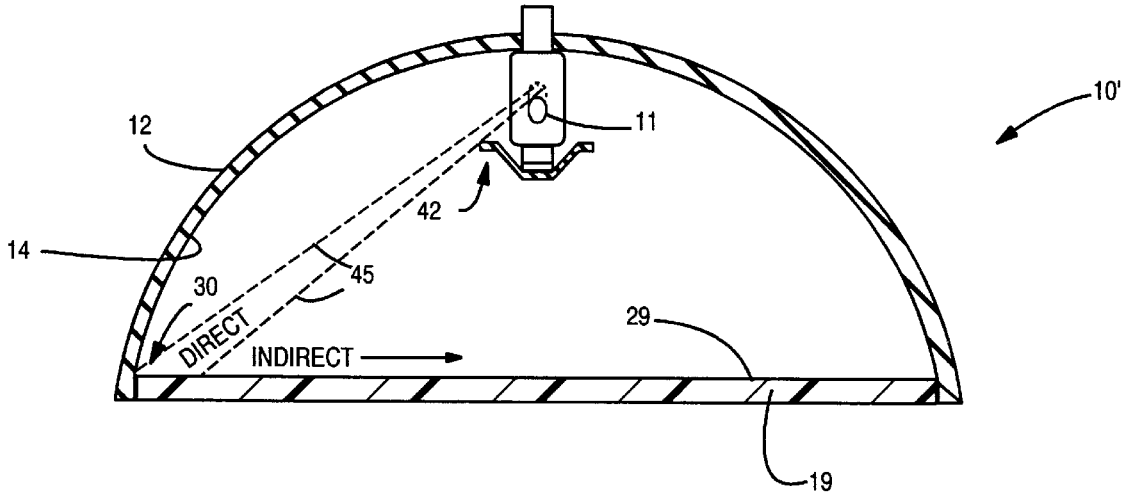
FIG. 4 is a view like that of FIG. 1 for a second embodiment of a light source assembly according to the invention.
Figure 5:
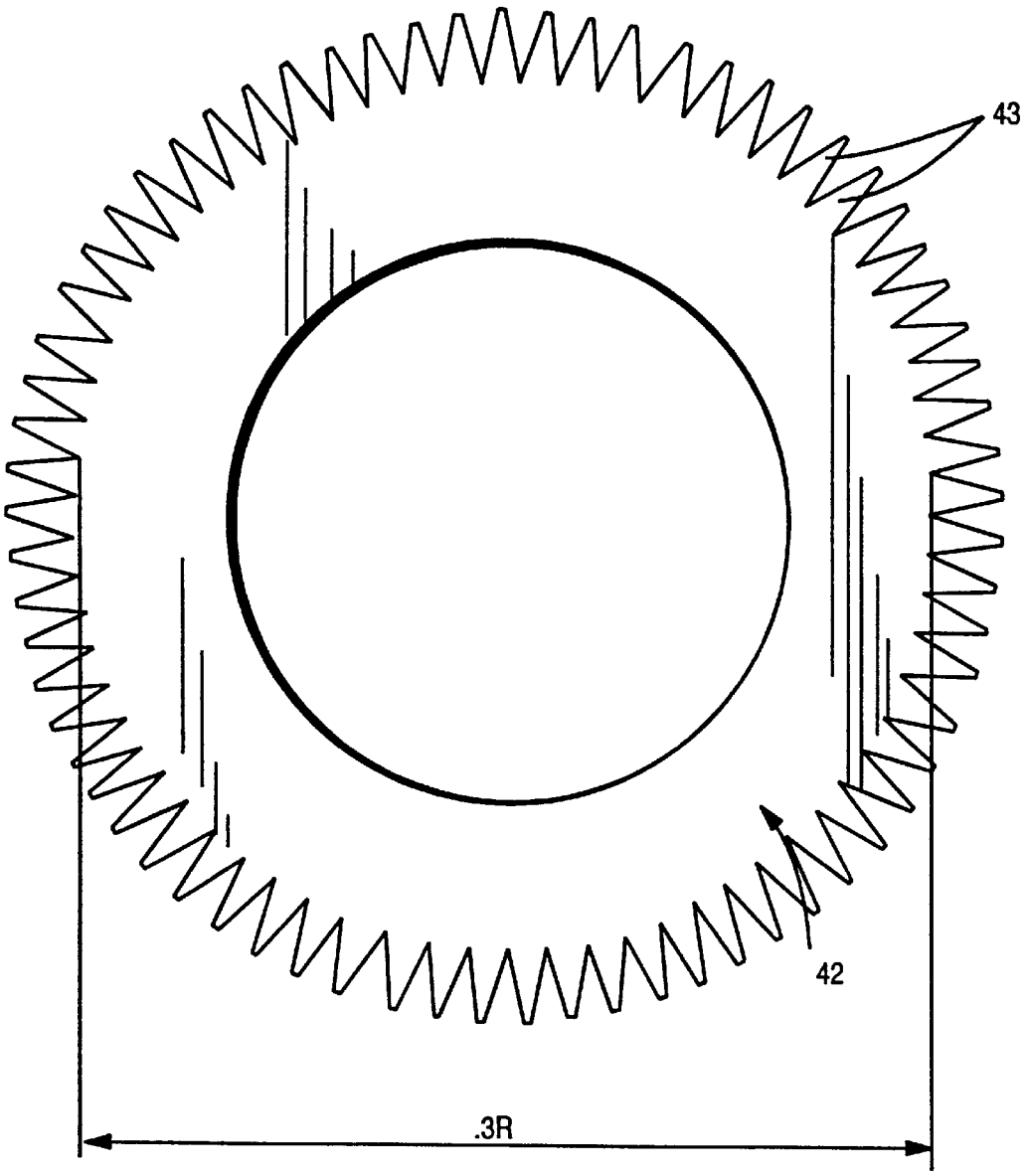
FIG. 5 is a bottom plan view of the second reflector from the FIG. 4 embodiment.

FIGS. 4 and 5 illustrate a second exemplary embodiment of a light source assembly 10' according to the invention. Most of the components in the FIGS. 4 and 5 embodiment are the same as those in the FIGS. 1 and 2 embodiment and therefore are shown by the same reference numeral. The only significantly different element is the second reflector 42. In the FIGS. 4 and 5 embodiment the second reflector 42 has a feathered (or meandering) edge 43. The basic "1-2-3" (or "1-2-3.5") geometry from the FIGS. 1 and 2 embodiment is not changed if the feathered edge 43 is considered as an aureole added to the basic diameter (0.3 R) of the second area reflector 42, as illustrated in FIG. 5. In this case the secondary reflector 42 does not block all direct illumination of the diffuser 19 by the light emitting element 11, but rather some direct illumination—such as illustrated by the volume between the rays 45 illustrated in FIG. 4—of the diffuser 19, adjacent the first reflector 12 (that is at the periphery 30 of the diffuser 19) is provided. This allows the high uniformity of illumination of the diffuser 19 of the FIGS. 1 and 2 embodiment to be maintained while still utilizing direct rays (45) from the source 11, and eliminating any need for roughening (as at 31 in FIG. 1) of the diffuser interior surface 29.

It will thus be seen that according to the present invention an advantageous light source assembly has been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A light source assembly, comprising:

a light emitting element;

a first reflector having an interior diffuse reflective surface comprising a portion of a surface of revolution, having a center axis;

a second reflector;

a diffuser;

said diffuser connected to said first reflector, said light emitting element substantially centrally located on said center axis between said reflectors, and said second reflector located between said diffuser and said light emitting element; and wherein said surface of revolution has a radius R, and wherein said light emitting element is positioned on said center axis approximately 0.1 R from said first reflector interior surface, and wherein said second reflector is positioned approximately 0.2 R from said first reflector interior surface along said center axis; and wherein said second reflector has a diameter, substantially perpendicular to said center axis, of approximately 0.3 R–0.4 R.

2. An assembly as recited in claim 1 wherein said diffuser is located within a range of ±0.3 R from the intersection of imaginary radii of said first reflector interior surface along said light emitting element and perpendicular to said light emitting element.

3. An assembly as recited in claim 1 wherein said first reflector is a partial sphere, parabolic, or partial ovoid, and wherein said second reflector is circular in plan if said first reflector is a partial sphere, ellipsoid, or partial ovoid.

4. An assembly as recited in claim 1 wherein said second reflector has a feathered edge so that some direct light from said light emitting element impacts said diffuser adjacent said first reflector.

5. An assembly as recited in claim 1 wherein said light emitting element comprises a single arc lamp or single filament lamp.

6. An assembly as recited in claim 1 wherein said assembly has a non-uniformity, at said diffuser, of about 10% or less, and wherein said second reflector has a diameter of about 0.35 R.

7. An assembly as recited in claim 1 wherein said first reflector interior surface comprises integrating sphere paint.

8. An assembly as recited in claim 7 wherein said paint has pigments or phosphors for color correction.

9. An assembly as recited in claim 1 wherein said diffuser has an interior surface and an outer periphery adjacent said first reflector; and wherein said interior surface of said diffuser is roughened compared to the rest of said interior surface of said diffuser to offset the index of refraction of said diffuser for rays making an oblique angle with a normal to said diffuser interior surface.

10. An assembly as recited in claim 1 wherein said first reflector is substantially hemispherical, and said light emitting element is a single metal halide lamp; and wherein said lamp and diffuser have dimensions proportional to about 175 watts for said lamp and about 19 inches in diameter for said diffuser, for an R=10 inches first reflector; and wherein said diffuser has a surface brightness of at least 2000 footlamberts.

11. An assembly as recited in claim 1 wherein said second reflector reduces the apparent surface brightness of the center of said first reflector, and blocks the majority of direct illumination of said diffuser by said light emitting element.

12. An assembly as recited in claim 11 wherein said second reflector completely blocks direct illumination of said diffuser by said light emitting element.

13. An assembly as recited in claim 11 wherein said second reflector has a feathered peripheral edge which allows some direct illumination of said diffuser, adjacent said first reflector, by said light emitting element.

14. A light source assembly, comprising:

a light emitting element;

a first reflector having an interior reflective surface comprising a portion of a surface of revolution having a radius R, and having a center axis;

said light emitting element positioned on said center axis approximately 0.1 R from said first reflector interior surface;

a second reflector positioned approximately 0.2 R from said first reflector interior surface along said center axis; and having a diameter, substantially perpendicular to said center axis, of approximately 0.3 R–0.4 R; and a diffuser connected to said first reflector, said second reflector located between said diffuser and said light emitting element.

15. An assembly as recited in claim 14 wherein second reflector reduces the apparent surface brightness of the center of said first reflector, and blocks the majority of direct illumination of said diffuser by said light emitting element.

16. An assembly as recited in claim 15 wherein said second reflector completely blocks direct illumination of said diffuser by said light emitting element.

17. An assembly as recited in claim 15 wherein said second reflector has a feathered peripheral edge which allows some direct illumination of said diffuser, adjacent said first reflector, by said light emitting element.

18. An assembly as recited in claim 14 wherein said assembly has a non-uniformity, at said diffuser, of 10% or less.

19. A light source assembly, comprising:

a single metal halide lamp;

a housing containing said lamp and including an interior and an exterior;

at least about half of said housing interior having a diffuse reflective surface;

a diffuser defining part of said exterior; and when said lamp is energized said assembly at said diffuser having a surface brightness of at least about 2000 footlamberts and a non uniformity of 10% or less.

20. A light source assembly s recited in claim 19 wherein said diffuse reflective surface comprises integrating sphere paint.

* * * * *